US008383229B2

(12) United States Patent
Franklin

(10) Patent No.: US 8,383,229 B2
(45) Date of Patent: Feb. 26, 2013

(54) PROTECTIVE PAD FOR USE DURING ATHLETIC ACTIVITIES

(76) Inventor: Kerry Franklin, Monmouth Junction, NJ (US)

( * ) Notice: Subject to any disclaimer, the term of this patent is extended or adjusted under 35 U.S.C. 154(b) by 0 days.

(21) Appl. No.: 13/443,317

(22) Filed: Apr. 10, 2012

(65) Prior Publication Data

US 2012/0240302 A1 Sep. 27, 2012

Related U.S. Application Data

(63) Continuation-in-part of application No. 12/462,137, filed on Jul. 30, 2009, now abandoned.

(60) Provisional application No. 61/189,541, filed on Aug. 21, 2008.

(51) Int. Cl.

| | |
|---|---|
| ***B32B 3/28*** | (2006.01) |
| ***B32B 3/30*** | (2006.01) |
| ***A41D 13/00*** | (2006.01) |
| ***A47J 45/10*** | (2006.01) |

(52) U.S. Cl. ..... 428/156; 428/167; 2/16; 2/20

(58) Field of Classification Search ..... 428/156, 428/167, 172; 2/16, 20; 482/49, 138; 81/3.4; 473/300, 301, 302, 303, 205; 16/435; 38/95; 602/21; 294/25, 33

See application file for complete search history.

(56) References Cited

U.S. PATENT DOCUMENTS 5,603,679 A * 2/1997 Reis ..... 482/106

* cited by examiner

*Primary Examiner* — Catherine A Simone
(74) *Attorney, Agent, or Firm* — Daniel Kirshner

(57) ABSTRACT

A protective pad to be employed by a person engaged in athletic activity utilizes to protect the user's hands formed from a very thin rectangular piece of rubber having a thickness of approximately 0.032 inch. On the top side of the protective pad are located treads upraised from the top surface of the pad. The treads are evenly spaced and approximately ½ inch apart and have triangular cross sections. The bottom side of the protective, which is the side placed against the grip portion of the piece of athletic equipment, is generally flat and has a tacky surface. The user wraps the protective pad around the grip portion of the piece of athletic equipment with the bottom tacky side of the pad adjacent to the grip.

1 Claim, 2 Drawing Sheets

PROTECTIVE PAD FOR USE DURING ATHLETIC ACTIVITIES

CROSS REFERENCE TO RELATED APPLICATION

This application is related to and claims priority and a filing date of the Provisional Application bearing Application No. 61/189,541 and a filing date of Aug. 21, 2008, and is a continuation in part of the Application bearing Ser. No. 12/462,137 and a filing date of Jul. 30, 2009, which is now abandoned.

FIELD OF THE INVENTION

The present invention is a protective pad for use during athletic activities and more specifically a substantially rectangular flat protective pad formed from thin rubber or a flexible material having treads on one surface and is tacky on both surfaces.

BACKGROUND OF THE INVENTION

Weight training is a common type of strength training for developing the strength and size of skeletal muscles. It uses the force or gravity (in the form of weighted bars, dumbbells or weighted stacks) to oppose the force generated by muscle through concentric or eccentric contraction. Weight training uses a variety of specialized equipment to target specific muscle groups and types of movement. Weight training differs from bodybuilding, weightlifting, powerlifting and strongman, which are sports rather than forms of exercise. Weight training, however, is often part of the athlete's training regimen. Weight training can be one of the safest forms of exercise, especially when the movements are slow, controlled and carefully defined. However, as with any form of exercise, improper execution can result in injury. Aside from the obvious dangers such as pulled muscles, weight trainers must also look out for their hands. Applying too much pressure on the bars and handles can quickly result in painful blisters and unattractive calluses. To help prevent this, weight trainers typically employ protective gloves, wearing these as they work out. Unfortunately, gloves can present a couple of challenges. Particularly, these athletic accessories tend to be quite expensive, and can provide an impractical expense for many. In addition, most weight trainers feel that the gloves can hinder hand control, resulting in slippage as well as inaccurate weight pressure.

Revealed in the prior art are several devices to be employed either as gripping aids or protective pads for gripping weights or for use with other such devices having grips or handles. None of the prior art, however, includes all of the unique combination of elements of the present invention protective pad, which unique elements are disclosed herein. For example, U.S. Pat. No. 6,183,400 B1, entitled Hand at Rest Grip, issued to Pope on Feb. 6, 2001 discloses an attachment device for dumbbells and the like. The device is made up of two parts hingedly attached together to form a grasping area. Another example is disclosed in U.S. Pat. No. 6,988,295 B2 issued to Tillim on Jun. 24, 2006 which patent shows an apparatus for gripping.

As none of the prior art disclosed the combination of elements of the present invention, the following are objectives of the protective pad disclosed herein. The protective pad would be simple to manufacture and lightweight and therefore facilitates the athlete carrying one or several of the pads of the present invention in his or her gym bag. The pad is manufactured from durable yet comfortable very thin rubberized material and is generally rectangular. On the top side of the invention, which is the side adjacent to the user's hands during employment, are disposed a plurality of treads to improve gripability and tactile feel. The bottom side of the invention is generally flat. Both surfaces and the treads have a tacky or static surface which slightly adheres to the grip of the dumbbell.

One object of the present invention is to absorb pressure placed onto the hands during the course of weight training thereby providing the user with a comfortable grip. Another objective of the present invention is to provide the user with a firm and stable grip onto the gripping portion of an exercise machine or barbell or dumbbell. This in turn obviates the necessity for the athlete to purchase, carry and employ more expensive, yet clumsier weight training gloves. A further advantage of the present invention is that the protective pad of the present invention could be utilized in a wide variety of athletic endeavors such as in connection with golf, tennis baseball and the like.

Other objects, advantages and novel features, and further scope of applicability of the present invention will be set forth in the detailed description to follow, taken in conjunction with the accompanying drawings, and in part will become apparent to those skilled in the art, upon examination of the following, or may be learned by practice of the invention. The objects and advantages of the invention may be realized and attained by means of instrumentalities and combinations particularly pointed out in the appended claim or claims.

SUMMARY OF THE INVENTION

The present invention is a protective pad to be employed by a person engaged in an athletic activity to protect the user' hands from the grip portion of a piece of athletic equipment. The protective pad is formed from a rectangular piece of very thin rubber. On the top side of the protective pad are located treads which treads are upraised from the top surface of the pad. The treads are evenly spaced and approximately ½ inch apart and have triangular cross sections. The top side of the protective pad is the side that is adjacent to the user's hand during employment. The bottom side of the protective pad does not have treads. Instead, the bottom side, which is the side placed against the grip portion of the piece of athletic equipment, is generally flat. Both the top side and the bottom side and the treads have a tacky surface. The user wraps the protective pad around the grip portion of the piece of athletic equipment with the bottom tacky side of the pad adjacent to the grip.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
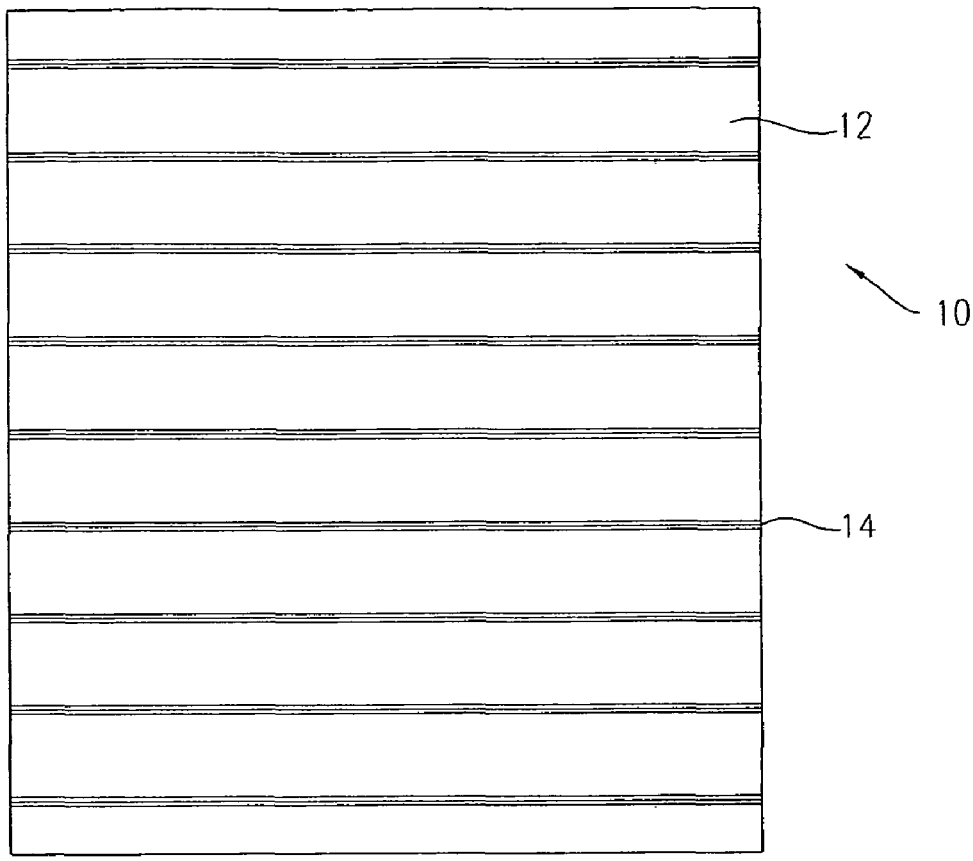
FIG. 1 is a top view of the present invention showing the invention top side up.

The present invention is a protective pad 10 that a person training with weights or involved in other such athletic activity utilizes to protect his or her hand completely while providing the best grip available onto the weights, dumbbells or sporting equipment. The pad is formed as a flat sheet of very thin flexible material having a top surface 12 and a bottom surface. As disclosed herein, the protective pad is formed from rubber, although another moldable, flexible material could be utilized. The preferred material from which the protective pad is formed is 40 durometer butyl and the preferred thickness of the flat sheet is approximately 0.018 inch. In any event, the thickness of the pad is no more than 0.026 inch. As such, the protective pad of the present invention is extremely thin to the touch.

Looking now at the drawings, the protective pad for use during weight training 10 of the present invention is generally rectangular in shape. Further, the protective pad of the present invention has uniform density throughout. The exact shape and dimension of the present invention are not critical. However, as disclosed herein, the protective pad measures approximately 4 inches by 4.5 inches which is a utilitarian size that fits most people's hands comfortably and conveniently, thereby completely covering the palm of the typical user, as well as being sized to cover the fingers of the user all the way to the finger tips, yet can be easily adjusted to fit everyone and conveniently adapts to cover the grip portion of a typical barbell, dumbbell or exercise machine.

On the top side of the protective pad are situated treads 14. The treads are slightly raised above the top surface of the protective pad. As shown in the preferred embodiment, the treads are evenly spaced apart across the top surface of the pad. More specifically, the treads are spaced approximately ½ inch apart with the first and last tread located approximately ¼ inch from the four-inch side of the pad. As such, in the preferred embodiment, there are typically nine treads extending across the five-inch span of the pad each of the treads parallel to the other treads.

Figure 2:
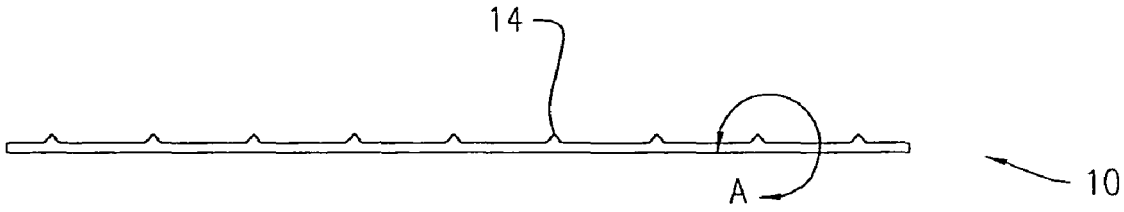
FIG. 2 is a cross-sectional view of the present invention.
Figure 3:
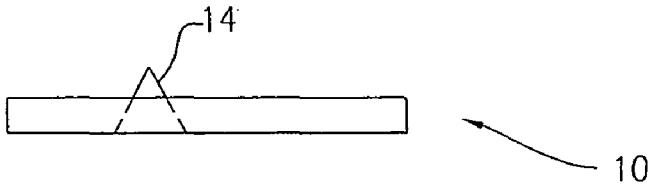
FIG. 3 is a cross-sectional detail view of the present invention, the section taken at A of FIG. 2, showing one of the treads.

Looking at FIG. 2 which is a cross-sectional view and FIG. 3 which is cross-sectional view of one of the treads of the invention which section is taken at 'A' of FIG. 2, it can be appreciated that the treads are raised above the top surface of the protective pad and are generally triangular in cross-section. The two side walls of each side of the upraised tread are angled approximately 58.89° apart. Each tread reaches a height of approximately 0.031 inch above the top surface of the protective pad. As such, the treads of the present invention all rise to a uniform height.

The bottom surface of the protective pad, which is the surface that is placed against the grip of the barbell or weight does not contain treads. Instead, the bottom surface is generally flat. Both the top surface and the bottom surface have are tacky which facilitates a better grip. More specifically, the top and bottom surfaces are tacky, but do not include permanent glue or adhesive. Moreover, the treads upraised from the top surface are tacky as well. As such, the protective device of the present invention adheres to the athletic equipment, but the adhesion is not permanent. Thus, the protective pad, although lightly adhering to the athletic equipment, is easily removable therefrom and easily repositionable. Furthermore, due to the rubber composition of the present invention, through extended use the tackiness of the material increases. In other words, the longer the protective pad of the present invention is used, the tackier it becomes. The grips become tacky to the point that if desired, the grips stay adhered to the bar of the athletic equipment by simply overlapping one end over another and no adhesive is required.

To utilize the present invention, the user wraps the protective pad around the grip portion of the handle of the barbell or other such athletic equipment. Alternatively, the protective pad can be positioned against the hand and covering the palm and fingers of the user. Typically, the user would employ two protective pads, one for each hand. The flat, tacky bottom side of the protective pad is placed against the grip of the equipment. The top tacky side, i.e. the side with the treads of the protective pad, is positioned next to the user's hand. Now, the protective pad is wrapped around the grip portion of the athletic equipment. In this way, the protective pad serves as a protective pad between the grip of the equipment and the user's hand and absorbs the pressure applied to the hand. Due to the tackiness of the pad, the pad enhances the grip of the athlete on the athletic equipment yet permits ready relocation of the pad on the hand or athletic equipment as needed. Due to the use of these grips, the athlete is helped to perform better and can, in fact, lift greater amounts of weight for any given exercise.

Once the user is finished employing the present invention protective pad, it is easily removable from the grip portion of the athletic equipment or repositioned thereon.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed is:

1. A removeable protective pad for protecting the palm and fingers of an athlete's hand from the grip portion of a piece of athletic equipment for use during athletic activity comprising:

a rectangular flat flexible sheet of rubberized material having a thickness in the range of 0.018 inch to 0.026 inch and sized to fit over and cover the palm and fingers of the user's hand, said sheet of material having a top surface and a bottom surface, said flat flexible sheet having uniform density, said bottom and top surfaces both being tacky, said top surface having treads upraised from its surface, said treads having triangular cross section, said treads between spaced apart at equal intervals and all treads upraised a uniform height from said top surface and lying parallel to the other treads, said treads being tacky;

whereby a user wraps the pad around the grip portion of the piece of athletic equipment with the said bottom surface adjacent to the grip portion, and whereby the user can remove or reposition the pad from the grip portion of the piece of athletic equipment when the athletic activity is finished.

* * * * *